US010488144B2

(12) United States Patent
Hughes

(10) Patent No.: US 10,488,144 B2
(45) Date of Patent: Nov. 26, 2019

(54) FLEXIBLE CABLE GUARD

(71) Applicant: Bear Archery, Inc., Evansville, IN (US)

(72) Inventor: Andrew Hughes, Evansville, IN (US)

(73) Assignee: Bear Archery, Inc., Evansville, IN (US)

( * ) Notice: Subject to any disclaimer, the term of this patent is extended or adjusted under 35 U.S.C. 154(b) by 0 days.

(21) Appl. No.: 15/995,526

(22) Filed: Jun. 1, 2018

(65) Prior Publication Data

US 2018/0347934 A1 Dec. 6, 2018

Related U.S. Application Data

(60) Provisional application No. 62/514,313, filed on Jun. 2, 2017.

(51) Int. Cl.
*F41B 5/14* (2006.01)
*F41B 5/10* (2006.01)

(52) U.S. Cl.
CPC ..... *F41B 5/14* (2013.01); *F41B 5/10* (2013.01); *F41B 5/1403* (2013.01)

(58) Field of Classification Search
CPC .. F41B 5/10; F41B 5/14; F41B 5/1403; F41B 5/1426
USPC ..... 124/25.6, 86, 88
See application file for complete search history.

(56) References Cited

U.S. PATENT DOCUMENTS 4,452,222 A * 6/1984 Quartino ..... F41B 5/10 124/23.1
4,834,061 A * 5/1989 Chattin ..... F41B 5/1426 124/86
5,146,908 A * 9/1992 Larson ..... F41B 5/10 124/25.6
5,161,514 A * 11/1992 Cary ..... F41B 5/143 124/24.1
5,392,757 A * 2/1995 Head ..... F41B 5/14 124/25.6
5,415,149 A * 5/1995 Derus ..... F41B 5/14 124/23.1
5,553,600 A * 9/1996 Miller ..... F41B 5/10 124/25.6
5,651,355 A * 7/1997 Gallops, Jr. ..... F41B 5/10 124/25.6
5,791,324 A * 8/1998 Johnson ..... F41B 5/10 124/25.6
6,152,124 A * 11/2000 Gallops, Jr. ..... F41B 5/10 124/25.6

(Continued)

*Primary Examiner* — Alexander R Niconovich
(74) *Attorney, Agent, or Firm* — Woodard, Emhardt, Henry, Reeves & Wagner, LLP; William McKenna; Charles Meyer

(57) ABSTRACT

In certain embodiments, an archery bow comprises an archery bow body defining opposing limb tips having rotational elements and a bowstring extending between the limb tips. At least one cable portion extends between the limb tips. A flexible cable guard extends from the archery bow body. The flexible cable guard is formed from a center shaft mounted to the archery bow body, the support core having at least a first section having a greater diameter or cross sectional width than that of a second distal section. A flexible cover or sleeve may be arranged over the shaft. The cover may have a low-friction surface to enable the cables or a slide assembly to slide freely thereon.

20 Claims, 4 Drawing Sheets

(56) References Cited

U.S. PATENT DOCUMENTS 6,330,881 B1 * 12/2001 Pippard ..... F41B 5/066 124/25.6
6,532,945 B1 * 3/2003 Chattin ..... F41B 5/10 124/25.6
6,655,371 B2 * 12/2003 Gallops, Jr. ..... F41B 5/10 124/25.6
6,708,684 B2 * 3/2004 Chattin ..... F41B 5/10 124/25.6
6,889,679 B2 * 5/2005 Chattin ..... F41B 5/10 124/25.6
6,904,900 B2 * 6/2005 Gallops, Jr. ..... F41B 5/10 124/25.6
8,307,816 B2 * 11/2012 Darlington ..... F41B 5/14 124/1
8,371,283 B2 * 2/2013 Grace ..... F41B 5/14 124/25.6
8,424,511 B2 * 4/2013 Grace, Jr. ..... F41B 5/14 124/25.6
8,616,189 B2 12/2013 McPherson et al.
8,651,097 B2 2/2014 Grace, Jr. et al.
8,784,628 B2 * 7/2014 Grace, Jr. ..... F41B 5/1403 124/25.6
9,046,317 B2 * 6/2015 McPherson ..... F41B 5/1426
9,291,422 B1 * 3/2016 Gold ..... F41B 5/1403
9,303,946 B2 * 4/2016 McPherson ..... F41B 5/1403
9,989,329 B2 * 6/2018 Kelly ..... F41B 5/1403
RE47,036 E * 9/2018 Batdorf ..... F41B 5/10
2012/0204851 A1 * 8/2012 McPherson ..... F41B 5/10 124/25.6
2013/0061838 A1 * 3/2013 Gordon ..... F41B 5/10 124/25.6
2014/0283807 A1 * 9/2014 Prater ..... F41B 5/10 124/25.6
2014/0299116 A1 * 10/2014 Yehle ..... F41B 5/10 124/25.6
2015/0027425 A1 1/2015 Yehle
2016/0097612 A1 4/2016 Gold et al.

* cited by examiner

FLEXIBLE CABLE GUARD

CROSS-REFERENCE TO RELATED APPLICATIONS

This application claims the benefit of U.S. Provisional Application Ser. No. 62/514,313, filed Jun. 2, 2017, which is hereby incorporated by reference in its entirety.

FIELD OF THE INVENTION

The present invention relates generally to archery bows and more particularly pertains to a flexible cable guard for use with and mounted to an archery bow.

BACKGROUND OF THE INVENTION

Certain archery bows, such as compound bows, store energy by a cable arrangement involving a bowstring, rotational elements and additional cable portions extending between the respective ends of the bow. In certain arrangements, cable guards are used to engage certain cable arrangements and displace them horizontally to provide clearance for the bowstring and arrow to be drawn and released without interference from these other cable portions. Further arrangements may include a slider assembly for retaining the additional cable portions while sliding laterally on the cable guard.

SUMMARY

Archery bow arrangements according to certain preferred embodiments described herein include an archery bow body defining opposing limb tips and a bowstring extending between the limb tips. At least one cable portion in addition to the bowstring extends between the limb tips and a flexible cable guard extends from the archery bow body. The flexible cable guard has a cable contact surface for applying a lateral force to the at least one cable portion to maintain it in a different plane than the bowstring.

In certain embodiments, a flexible cable guard for a bow includes: a support core, a mounting portion at or near the proximal section of the support core, and a contact surface at or near the middle section and/or distal section of the support core. The mounting portion may be a bracket of the type commonly known to enable accessories to be secured to an archery bow body, such as the riser of an archery bow. The cable guard is designed to displace the at least one cable horizontally to provide clearance for the bowstring and arrow to be drawn and released without interference from the at least one cable. In certain forms, the flexible cable guard includes a slider assembly which retains selected cables of the archery bow and translates along the length of the support core.

In certain embodiments of the flexible cable guard for an archery bow, the support core is made from a semi-rigid material and has two or more sections along its length, each having differing diameters (or cross sectional widths), with the distal section having a smaller diameter than that of the proximal section. The flexible cable guard may also include a flexible material mounted to, within or surrounding at least a portion of the support core. This flexible material may cover at least the portion of the cable guard which contacts and applies a retaining force to the cable portions. In some forms, the flexible material also provides for a low friction surface. In one form a slider assembly retains the additional cable portions and slides laterally on the flexible cable guard.

Other objects and attendant advantages will be readily appreciated as the same become better understood by references to the following detailed description when considered in connection with the accompanying drawings.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the invention relates.

Figure 1:
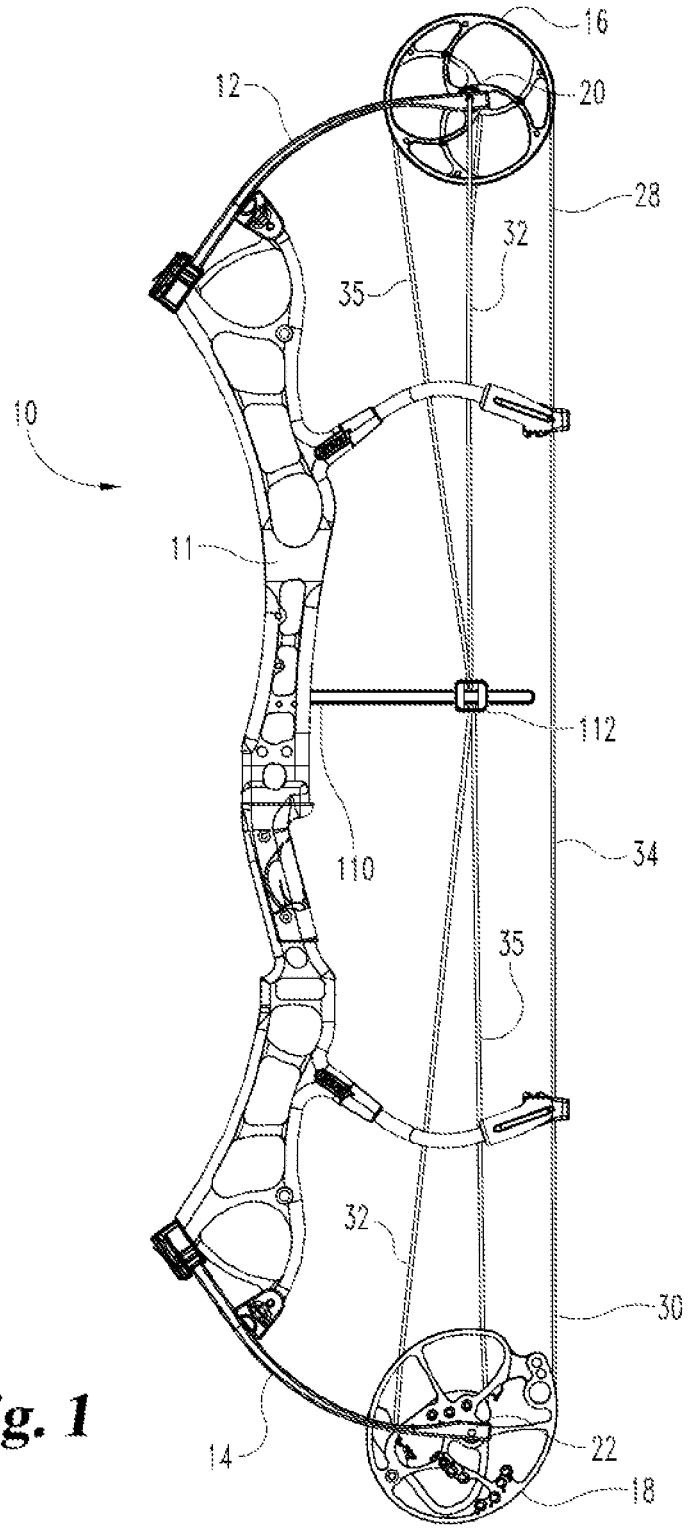
FIG. 1 is a side view of a single cam bow in an undrawn position incorporating a flexible cable guard and slide assembly according to an embodiment of the present disclosure.
Figure 2:
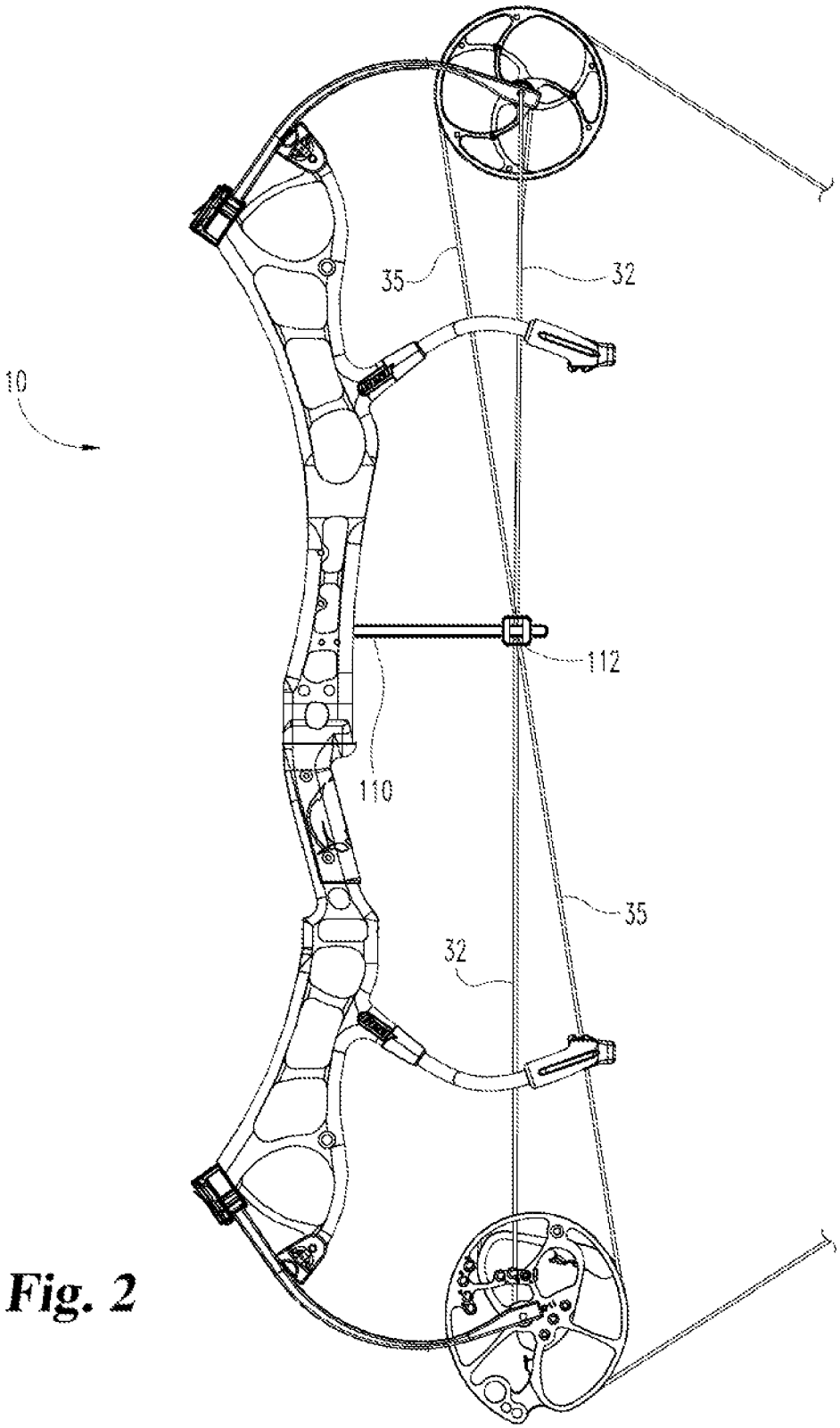
FIG. 2 is a side view of the bow and flexible cable guard and slide assembly of FIG. 1, with the bow in a drawn position.
Figure 3:
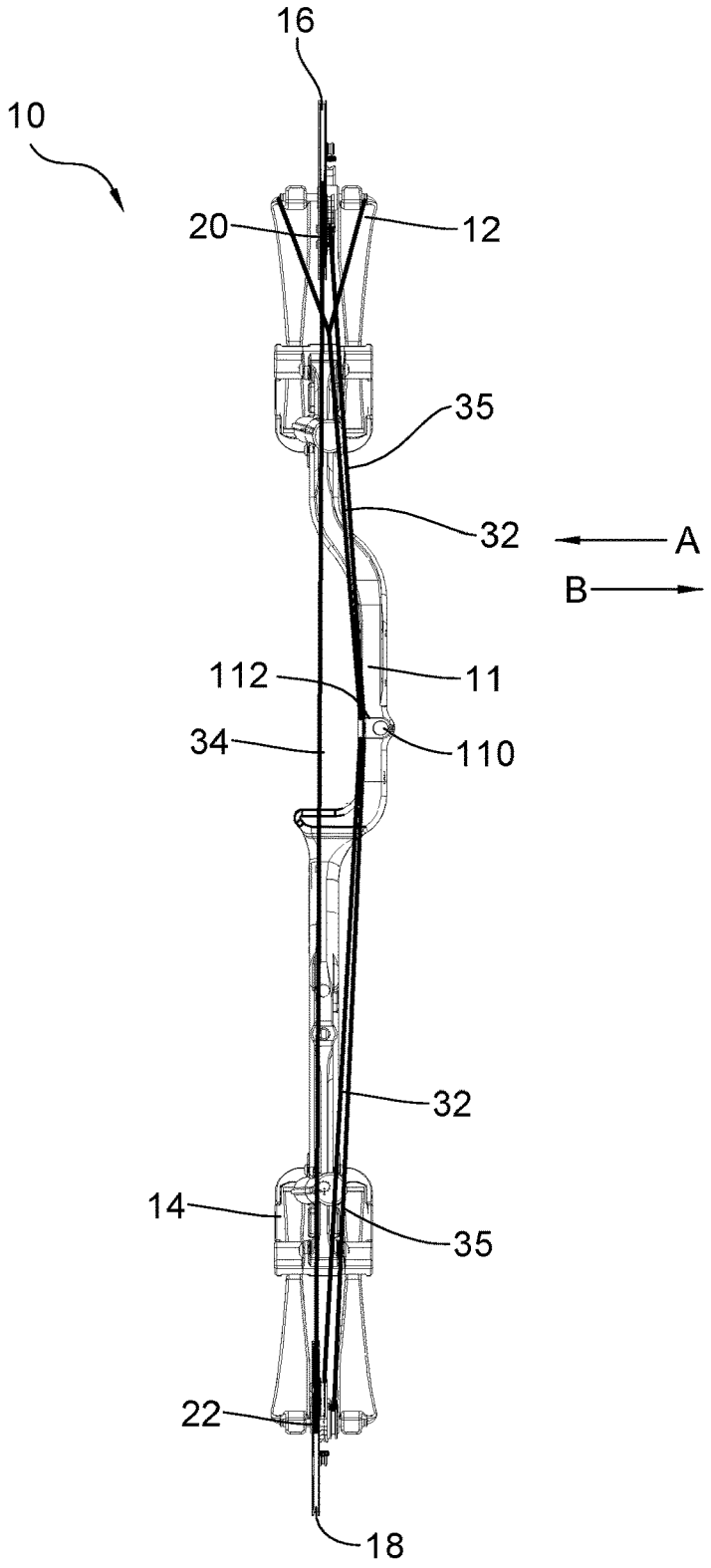
FIG. 3 is a partial end view of the bow and flexible cable guard and slide assembly of FIG. 1, with the bow in a drawn position.
Figure 4:
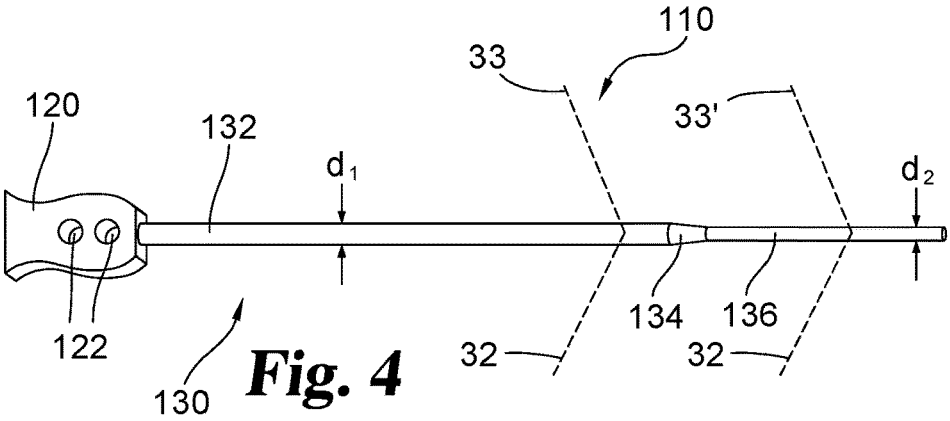
FIG. 4 is a perspective view of one embodiment of the flexible cable guard.

FIGS. 1-3 illustrate one example of a conventional single cam compound archery bow generally designated as 10. Bow 10 it includes a riser 11 with a handle, an upper limb portion 12 and a lower limb portion 14. In the single cam example illustrated, rotational members such as idler wheel 16 and eccentric cam 18 are supported at the limb tip sections for rotary movement about axles 20 and 22. In the embodiment shown, upper and lower limbs are formed of parallel and symmetric limb portions sometimes called quad limbs. Alternately, a single piece limb can have a notch or slot area removed to allow a rotational element to be mounted to the limb tips. An upper pulley axle 20 is carried between the outer limb tip portions of upper limb 12. A lower pulley axle 22 is carried between the outer limb tip portions of lower limb 14.

The portion of the cable which defines the bowstring cable 34 includes an upper portion 28 and a lower end portion 30 which are fed-out from idler wheel 16 and cam 18 when the bow is drawn. The upper end portion 28 is part of a longer cable which has a medial portion mounted around idler wheel 16 with the ends mounted to cam 18. The non-bowstring portion of the cable extending from wheel 16 to cam 18 can be referred to as the return cable portion 35. Additionally, a y-yoke anchor cable 32 has a lower end mounted to cam 18 which extends to two upper ends mounted adjacent opposing ends of axle 20. Each cable has a thickness and a round cross-section defining a circumference. From the perspective of the archer, the bowstring is considered rearward relative to the riser which defines forward.

An arrow can be arranged between bowstring 34 and riser 11, for example with the arrow supported on an arrow rest formed by or mounted on riser 11. The arrow is typically perpendicular to bowstring 34 in the brace position. The arrow and bowstring define a plane in which the bowstring travels during the draw and release cycle, referred to herein as the plane of the bowstring. Broadly, the plane is vertical and passes front to back to include the riser, the arrow and the bowstring.

When the bowstring 34 is drawn, it causes idler wheel 16 and cam 18 at each end of the bow to rotate, feeding out cable and bending limb portions 12 and 14 inward, causing energy to be stored therein. When the bowstring 34 is released with an arrow engaged to the bowstring, the limb portions 12 and 14 return to their rest position, causing idler wheel 16 and cam 18 to rotate in the opposite direction, to take up the bowstring 34 and launch the arrow with an amount of energy proportional to the energy initially stored in the bow limbs. Bow 10 is described for illustration and context and is not intended to be limiting.

A typical cable guard, as is known in the art, is a rigid shaft (with a slider assembly, pulleys or other add-ons), which engages one or more cable portions, such as cables 32 and/or 35, and displaces them a fixed distance laterally from the plane which includes the bowstring and arrow, thus providing clearance, assisting the bowstring and arrow (including its fletchings) to be drawn and released without interference from the cable portions. In contrast, the present invention provides for variable lateral displacement of the cables during a shot. When viewed from the perspective of an archer holding the bow, as shown in FIG. 3, the flexible cable guard 110 (along with optional slider assembly 112) forces cables 32 and/or 35 away from the plane in which bowstring 34 travels, thereby forcing the cables and the bowstring to form a triangular shape (perpendicular to the arrow shaft) with its three end points at the idler wheel 16, cam 18 and the flexible cable guard 110. In operation, the flexible cable guard 110 flexes in varying amounts toward the plane occupied by the bowstring and the arrow shaft, thereby reducing the height of this triangle and bringing the slider assembly 112 and the cables 32 and/or 35 closer to the plane of the bowstring. This significantly reduces torque induced limb distortion and the resulting lateral nock travel as well as the overall wear and tear on the cables themselves. A more detailed description of this function will be described herein.

While not illustrated, the present disclosure can also be used in other types of bows, for example dual cam or two cam bows, hybrid cam bows or crossbows, which are considered conventional for purposes of the present invention. For convenience, the combination of riser 11 and either single or quad limbs forming upper limb 12 and lower limb 14 may generally be referred to as archery bow body 15. Accordingly, it should be appreciated that the archery bow body can take on various designs in accordance with the many different types of bows with which the present invention can be used.

In one embodiment, the flexible cable guard 110 includes a slider assembly 112 which serves to engage and/or retain one or more of the cable portions 32 and 35 of the bow. The slider assembly may be made from one or more pieces, as is known in the art, and may include slots, hooks, or another known mechanism to secure and apply a lateral force to the cable portions 32 and/or 35. This lateral force may be applied as a pushing or pulling force, depending upon which side of the flexible cable guard 110 the selected cables are placed. In operation, the slider assembly 112 slides along the flexible cable guard 110 as the bow is drawn and subsequently fired or released. In an alternate embodiment, the flexible cable guard 110 may be utilized without a slider assembly. In such an arrangement, the cable portions simply contact the outer side of the flexible cable guard 110, which is the side opposite of the bowstring.

In the illustrated embodiments, a flexible cable guard 110, as seen in FIGS. 1-6, extends rearward from the bow body 10, typically from the riser 11. One form of flexible cable guard 110, as more clearly seen in FIGS. 4-5 (with slider assembly 112 omitted for clarity), includes a mounting bracket 120 and a support core 130. Mounting bracket 120 may be of many different sizes and configurations to fit the bow to which it is to be secured. Mounting bracket 120 may also include one or more openings 122 which may interact with fasteners to secure flexible cable guard 110 to the archery bow 10, such as by using screws to secure it to the accessory mounting portions typically included on bow riser 11. It shall be appreciated that other embodiments of the flexible cable guard may or may not include a mounting bracket 120. For example, the flexible cable guard may be secured into the riser of a bow by being inserted into an opening therein and secured or affixed therein. The flexible cable guard 110 may also be integrated into the bow.

Generally, support core 130 is roughly between 5 and 8 inches in length, but may be shorter or longer depending upon the size of the mounting bracket 120 and/or the specific measurements of the bow upon which it is to be used. In the example illustrated, proximal section 132 of support core 130 has a cylindrical shape and a constant first diameter $d_1$. It shall be appreciated that for non-circular shaped embodiments, the cross sectional width (i.e. the maximum distance across the cross section) may be considered. The proximal section 132 is preferably made from a semi-rigid material which provides some level of resiliency in that it can repeatedly flex under load and return to its original position. Proximal section 132 is connected, either directly or indirectly, to distal section 136. In the example illustrated, distal section 136 also has a cylindrical shape, but has a constant diameter $d_2$, which is less than diameter $d_1$ of proximal section 132. The distal section 136 is preferably also made from a semi-rigid material which provides some level of resiliency. The reduced diameter of distal section 136 causes it to exhibit a greater level of flexibility than proximal section 132 when made from the same or similar material. The lengths and proportions of proximal section 132 and distal section 136 may vary to achieve different flex profiles as desired. However, for purposes of a non-limiting example, the proximal section may be equal to or slightly longer in length that the distal section 136. In one form, proximal section 132 and distal section 136 comprise the entire length of the cable guard 110 (excluding the mounting bracket 120). In other forms, the proximal section 132 and distal section 136 may comprise at least 50% of the length of the cable guard 110, at least 65% of the length of cable guard 110, or at least 80% of the length of cable guard 110.

In certain embodiments, the proximal section 132, transition section 134 and distal section 136 of support core 130 may be formed from one or more of: aluminum, steel, fiberglass or any other semi-rigid resilient material. The sections may be integral or connected together via welds, fasteners or some other suitably strong connection known for use with the material(s) selected. In one form, the proximal section 132 and the distal section 136 are made from the same material, and may be made from a single unitary piece. In one example, at least the distal section 136 of the support core 130 is made from carbon fiber. In a further form, each portion of the support core 130 is made from carbon fiber. Furthermore, while described herein as connected, it shall be understood that two or more of mounting bracket 120, proximal section 132, transition section 134 and distal section 136 (or any intermediate sections) may be formed from a single unitary piece of material depending upon design preferences and the desired deflection profile. Moreover, while a circular shaped cross-section is illustrated, any portion of support core 130 may be formed of a different cross-sectional shape, however, smooth shapes such as an oval, "D" shape, or the like lower the stress and wear placed upon the cable portions or the slider assembly 112 as they rest upon or slide along the length of the flexible cable guard 110.

In certain embodiments, a transition section 134 is included between adjacent sections, such as proximal section 132 and distal section 136, to smoothly transition the support core 130 between differing diameters, which in the illustrated embodiment are $d_1$ and $d_2$. The transition section 134 forms a smooth outer surface upon flexible cable guard 110 which provides for a smoother transition for the slider assembly 112 or the cable portions themselves (depending upon the embodiment selected) when moving laterally along its length. In addition, this transition section 134 provides greater strength and durability for the support core 130 than a sharply stepped arrangement. In a further form, support core 130 may include additional sections between proximal section 132 and distal section 136. In one form, the diameter of each successive section of the support core 130 is smaller when moving from the proximal section 132 to the distal section 136. In another form, the flexibility of the material (e.g. modulus of elasticity) chosen for each successive section of the support core 130 is different. In a still further form, the flexibility (e.g. measured as a lack of stiffness) of the material chosen for each successive section of the support core 130 is greater when moving from the proximal section 132 to the distal section 136. In one embodiment, the flexible cable guard 110 includes at least three sections having differing diameters. In yet a further embodiment, the flexible cable guard 110 includes at least four sections having differing diameters. In a still further embodiment, the flexible cable guard 110 includes at least five sections having differing diameters. In yet another form, the entire length of support core 130, or a significant portion thereof, may be of a tapered shape to provide for an increasing flexibility from the proximal section 132 to the distal section 136.

In contrast to a traditional rigid cable guard, the lateral displacement of the cable portions away from the bowstring provided by flexible cable guard 110 (as indicated by direction A or B in FIG. 3) varies depending upon the tension in the bow 10. When the bow 10 is at rest, the slide assembly 112 and/or the cables (represented collectively by 32 in FIGS. 4-5) are located at point 33 on the proximal section 132 of flexible cable guard 110. As the bow is drawn and tension is increased, the idler wheel 16 and cam 18 move rearward toward the archer and thus the slide assembly 112 and/or cables 32 and 35 slide toward the distal section of flexible cable guard 110, such as to the point indicated by 33'. At the same time, as the tension increases the flexible cable guard 110 flexes inwardly toward the bowstring 34 (as indicated by arrow A in FIG. 3). This inward movement is enhanced by the flexible cable guard 110 due to the slider assembly 112 and/or cable portions 32 sliding toward the distal section 136 of the flexible cable guard 110, thereby applying more torque as well as engaging more of the more flexible distal section 136.

As the bowstring 34 is released, tension is released and the flexible cable guard 110 begins to displace the cable portions further from the plane of bowstring 34 (as indicated by arrow B in FIG. 3). This outward movement is due to the reduced tension in the cables and the increasing effective rigidity of the flexible cable guard 110 as the slide assembly 112 and/or cable portions return from point 33' to point 33 of the flexible cable guard 110, thereby applying less torque as well as engaging only the stiffer proximal section 132 of the flexible cable guard 110. In effect, the flexible cable guard 110 acts to laterally displace the cables portions 32 to allow the arrow and fletching to clear during a shot, but serves to reduce this lateral displacement and the accompanying lateral stress on the cables when the bow is drawn.

Figure 5:
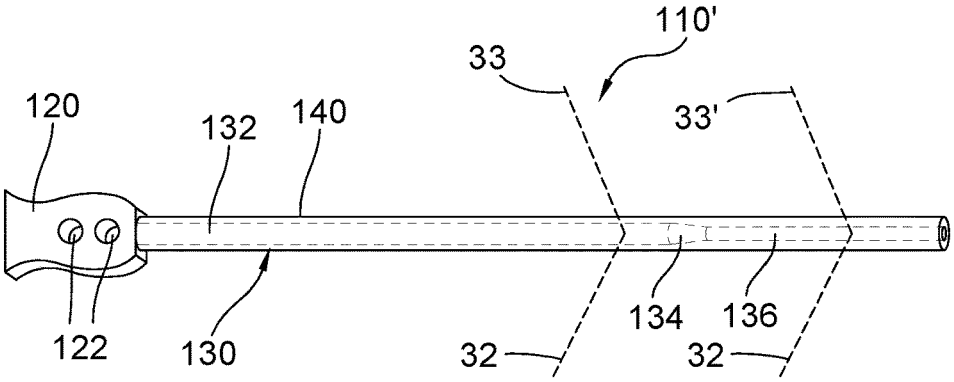
FIG. 5 is a perspective view of another embodiment of the flexible cable of FIG. 1.
Figure 6A:
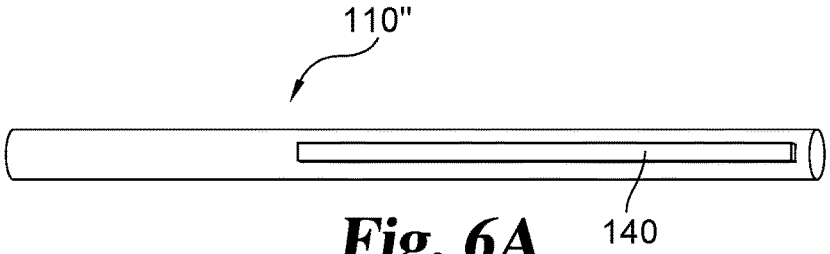
FIG. 6A is a perspective view of an alternate embodiment of a flexible cable guard.
Figure 6B:
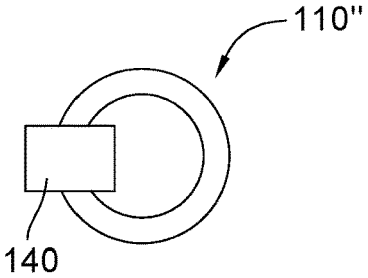
FIG. 6B is an end view of the alternate embodiment of a flexible cable guard shown in FIG. 6A taken from nearest the distal section.

In a further embodiment, shown in FIG. 5, flexible cable guard 110' may include a low friction surface 140 or sheath which surrounds and encloses support core 130 (shown in broken lines). This low friction surface 140 or sheath may have a consistent outer diameter along it length despite the varying diameter of the support core 130. Alternatively, low friction surface 140 may cover only a portion of the circumference of support core 130, such as the side of cable guard 110" which is opposite the bowstring, as is shown in FIGS. 6A and 6B. In this form, the low friction surface 140 may be partially inset within a recessed channel running along at least a portion of the length of core support 130 as is also shown in FIGS. 6A and 6B. This low friction surface 140 assists the slider assembly 112 and/or cable portions to translate along a portion of the length of the flexible cable guard freely despite the lateral forces placed upon it. As such, low friction surface 140 is applied to at least the side of the cable guard 110' or 110" that is opposite of the bowstring 34.

In certain forms, low friction surface 140 is of a constant diameter; however, in other forms low friction surface 140 may follow a similar profile to that of internal core support 130. Low friction surface 140 may be formed from a number of materials, including nylon, unreinforced nylon, plastic, various polymers, or any other suitable material having a low coefficient of friction. One suitable material for forming low friction surface 140 may be polytetrafluoroethylene (PTFE), which is sold under the trademark Teflon®.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An archery bow, comprising:

an archery bow body defining opposing limb tips;

a bowstring extending between said limb tips;

at least one cable portion other than the bowstring extending between said limb tips;

a cable guard secured to and extending from said archery bow body and restraining the at least one cable portion laterally away from a plane defined by the bowstring, said cable guard including:

a flexible support core with a proximal section having a first cross sectional width $d_1$ and a length $L_1$ and a distal section having a second cross sectional width $d_2$ and a length $L_2$, with said first cross sectional width $d_1$ being greater than said second cross sectional width $d_2$, and said flexible support core has a total length $L_C$; and a sheath surrounding at least a portion of each of the proximal section and the distal section, wherein the sheath is formed from a different material than said flexible support core and has a length $L_S$ and a uniform cross sectional width $s_1$ along the entirety of the sheath.

2. The archery bow of claim 1, wherein said first cross sectional width $d_1$ is constant along the length of said proximal section $L_1$ and the second cross sectional width $d_2$ is constant along the length of said distal section $L_2$.

3. The archery bow of claim 1, wherein said support core further includes a transition section between said proximal section and said distal section, said transition section having a cross sectional width which tapers from $d_1$ to $d_2$.

4. The archery bow of claim 1, wherein said support core further includes an intermediate section between said proximal section and said distal section, said intermediate section having a constant third cross sectional width $d_3$ which is greater than said second cross sectional width $d_2$ but less than said first cross sectional width $d_1$.

5. The archery bow of claim 1, wherein said cable guard further comprises a slider assembly which is configured to slide along at least a portion of the sheath while restraining said at least one cable portion laterally away from the plane of the bowstring.

6. The archery bow of claim 5, wherein said cable portion is retained by the slider assembly on the side of said sheath which is opposite to the bowstring.

7. The archery bow of claim 1, further comprising a strip of material applied along a portion of the length $L_S$ of the outer surface of said cable guard and parallel to the length of said support core $L_C$, and wherein said strip of material has a coefficient of friction lower than that of said sheath.

8. The archery bow of claim 1, wherein the proximal section and the distal section collectively comprise at least 50% of the length of said support core $L_C$.

9. The archery bow of claim 8, wherein the proximal section and the distal section collectively comprise at least 80% of the length of said support core $L_C$.

10. The archery bow of claim 1, wherein the sheath is formed from a low friction material.

11. The archery bow of claim 10, wherein the sheath is formed from a material selected from the group consisting of: nylon, plastic and polymer.

12. The archery bow of claim 1, wherein the flexible support core is formed from a material selected from the group consisting of: aluminum, steel, fiberglass and carbon fiber.

13. The archery bow of claim 12, wherein the flexible support core is formed at least partially from carbon fiber.

14. The archery bow of claim 13, wherein the proximal section and the distal section of the support core are formed entirely from carbon fiber.

15. The archery bow of claim 1, wherein the sheath has the uniform cross sectional width $s_1$ along the portion of the sheath which covers the proximal section of the support core.

16. The archery bow of claim 1, wherein the tension in the at least one cable is capable of bending the cable guard inward toward the plane of the bowstring when the bow is drawn.

17. The archery bow of claim 1, wherein the proximal section has a stiffness $S_P$ and the distal section has a stiffness $S_D$, where $S_P$ and $S_D$ are different.

18. An archery bow, comprising:

an archery bow body defining opposing limb tips;

a bowstring extending between said limb tips;

at least one cable portion other than the bowstring extending between said limb tips;

a cable guard secured to and extending from said archery bow body and restraining the at least one cable portion laterally away from a plane defined by the bowstring, said cable guard comprising:

a flexible support core having a proximal section and a distal section, wherein said flexible support core includes a recessed channel inset along at least a portion of each of the proximal and the distal section of the flexible support core; and an elongate pad of low-friction material secured within the recessed channel such that the pad of low-friction material extends from the proximal section to the distal section.

19. The archery bow of claim 18, wherein the proximal section has a first cross sectional width $d_1$ and the distal section has a second cross sectional width $d_2$, with said first cross sectional width $d_1$ being greater than said second cross sectional width $d_2$.

20. A flexible cable guard suitable for attachment to an archery bow having opposing limb tips, a bowstring extending between said limb tips, at least one cable portion other than the bowstring extending between said limb tips; the flexible cable guard capable of restraining the at least one cable portion laterally away from a plane defined by the bowstring, said cable guard comprising:

a flexible support core having a proximal section having a first cross sectional width $d_1$ and a distal section having a second cross sectional width $d_2$, with said first cross sectional width $d_1$ being greater than said second cross sectional width $d_2$; and a sheath surrounding at least a portion of each of the proximal section and the distal section, wherein the sheath is formed from a different material than said flexible support core and has a length $L_S$ and a uniform cross sectional width $s_1$ along the entirety of the sheath.

* * * * *